US007762710B2

(12) United States Patent
Chang

(10) Patent No.: US 7,762,710 B2
(45) Date of Patent: Jul. 27, 2010

(54) STRUCTURE IN THE OUTER ENVELOPING SHELLS OF CHRISTMAS LAMPS

(76) Inventor: Hsiu-Tsin Chang, 2F-1, No. 152, Nan Yar Street, Hsinchu (TW)

( * ) Notice: Subject to any disclaimer, the term of this patent is extended or adjusted under 35 U.S.C. 154(b) by 232 days.

(21) Appl. No.: 12/155,694

(22) Filed: Jun. 9, 2008

(65) Prior Publication Data

US 2009/0303734 A1 Dec. 10, 2009

(51) Int. Cl.
*F21V 3/00* (2006.01)

(52) U.S. Cl. ..... 362/654; 362/363

(58) Field of Classification Search ..... 363/363, 363/652, 653, 654

See application file for complete search history.

(56) References Cited

U.S. PATENT DOCUMENTS

| | | | | |
|---|---|---|---|---|
| 5,404,285 | A * | 4/1995 | Schonbek | 362/363 |
| 6,382,812 | B1 * | 5/2002 | Hsu | 362/653 |
| 2003/0147245 | A1 * | 8/2003 | Chen | 362/363 |

* cited by examiner

*Primary Examiner*—David V Bruce
(74) *Attorney, Agent, or Firm*—Rosenberg, Klein & Lee

(57) ABSTRACT

The present invention is to provide a structure improvement in the outer enveloping shells of Christmas lamps, which is characterized in that the outer enveloping shell is co-assembled by sleeved objects with different colors or different shell veins and formed an integrated outer shell. After being inserted, assembled and clip-fit in the lamp stand set with a LED lamp, it is then assembled and connected with an integrating stand set with the power line to form a complete Christmas lamp efficiently and practically.

6 Claims, 8 Drawing Sheets

STRUCTURE IN THE OUTER ENVELOPING SHELLS OF CHRISTMAS LAMPS

BACKGROUND OF THE INVENTION

It is known that the usage purpose of the outer enveloping shell in the Christmas lamp mainly is to further adjust the light sources of lamps such that different light sources can create different lighting effects. For example, different colored outer enveloping shells can be used to change then create lights with different colors, or the shell surface of an outer enveloping shell is made the processed with different veins to create different shining lighting. By the extension of this effect, it is gradually become popular currently in the market that a single outer enveloping shell is made and processed with two or more than two kinds of colors or veins to let the single Christmas lamp itself create more than two kinds of light sources' effects. And the processing method in the outer enveloping shell is to paint the shell surface with different colors or carve the shell surface with different vein. However, the case of color fading is occurred easily in the outer enveloping shell processed by the said method, and it takes time and work if processed by carving the shell surface then increase the manufacturing cost. Thus, these two processing methods both are not ideal enough and need to be improved.

SUMMARY OF THE INVENTION

The present invention is related to a structure improvement in the Christmas lamps' modules. A lamp's outer enveloping shell that is co-assembled by sleeved objects with different colors or different shell veins and formed as a whole is adopted to achieve the purpose of creating the lighting effects of different light sources. The structure and characteristics of the present invention will be described hereafter by referring to drawings.

DETAILED DESCRIPTION OF THE PREFERRED EMBODIMENT

Figure 1:
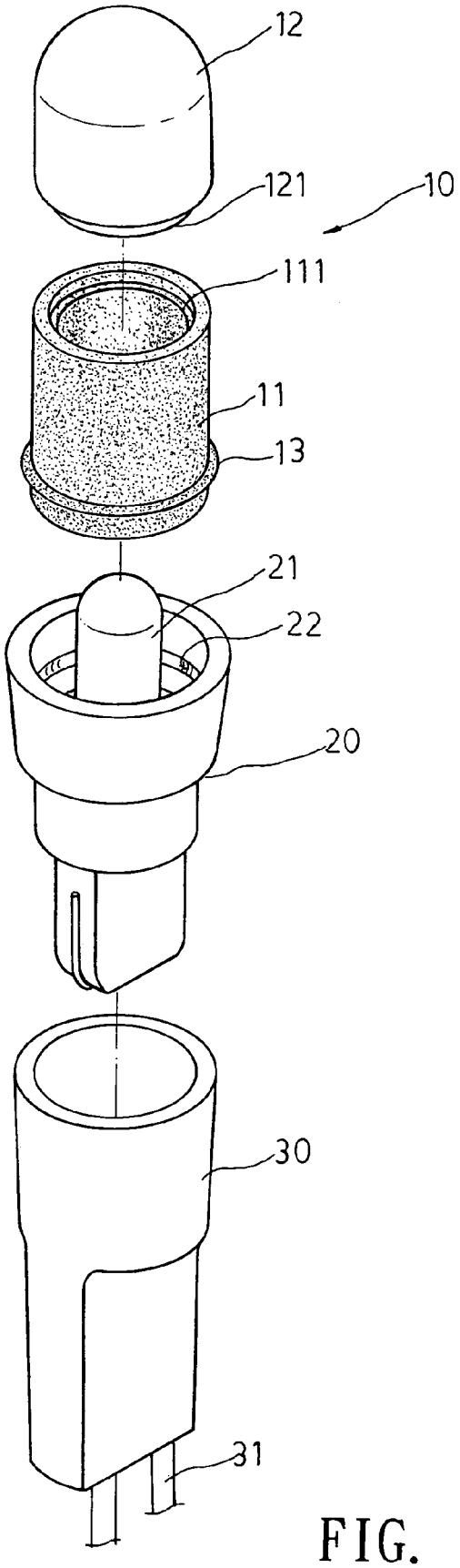
FIG. 1 is an analytic diagram of the structure in the present invention.

The innovation in the present invention is to equip the outer enveloping shell of the Christmas lamp with two or more than two kinds of different colors or veins, and its manufacturing method is suitable of automatic production for the purpose of lowering the manufacturing cost. Thus, the outer enveloping shell in the present invention utilizes the direct shaping sleeved objects with different colors or veins to be co-assembled and formed as a whole single body. As those shown in FIGS. 1 and 2, the said Christmas lamps include elements of an outer enveloping shell 10, a lamp stand 20 and integration stand 30. A LED lamp 21 is set on the lamp stand 20. A circular groove 22 used for clipping the outer enveloping shell 10 is set inside the stand. The said integrating stand 30 is used to assemble and connect the lamp stand 30 and a power line 31 is set inside it. And the improving feature of the present invention is in that the said outer enveloping shell 10 is assembled and formed as a whole body configure by a first sleeved object 11 and a second sleeved object 12 with different colors (or veins). A protruding rim 13 is formed on the outer surface close to the bottom in the first sleeved object 11 to be used for a clip-fit with a circular groove 22 of the lamp stand, and a grooved rim 111 is formed on the inner surface in the top opening. And, a lip rim 121 is formed in the bottom of the second sleeved object 12 to be used for an insert-fit assembly-connection with the grooved rim 111 in the first sleeved object 11, and the glue is applied to the integrating position to fix-connect the first and second objects then formed as a whole configuration.

Figure 2:
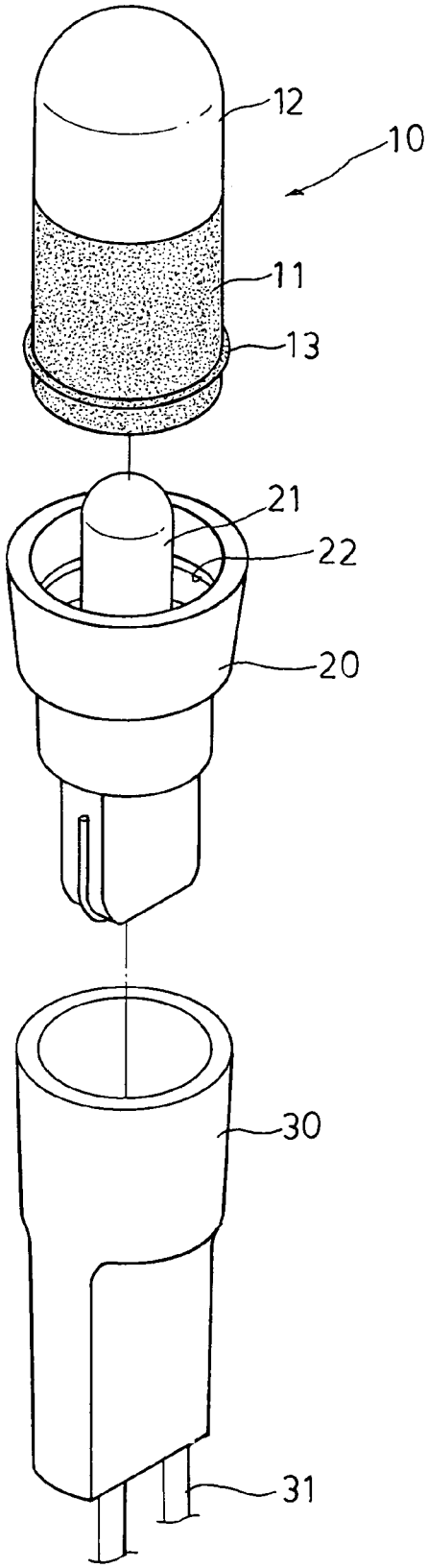
FIG. 2 is a diagram of an embodiment in the structure of the present invention.
Figure 3:
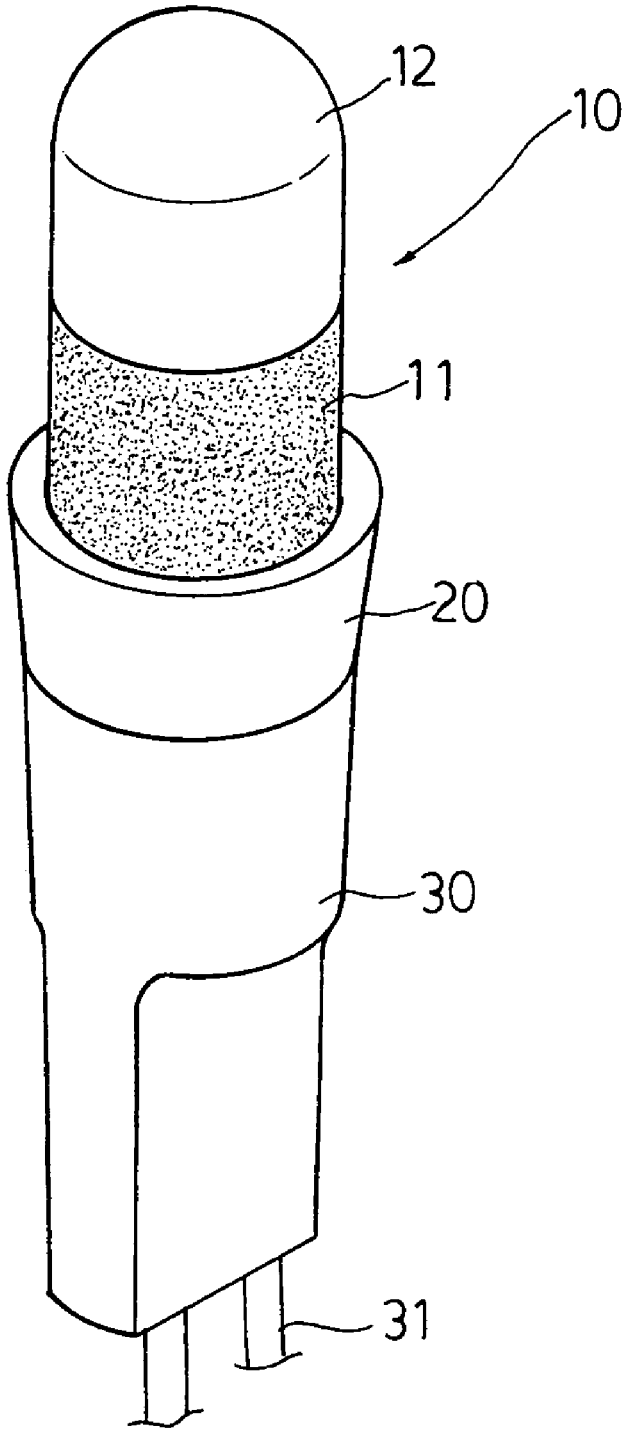
FIG. 3 is a three dimensional diagram of the structure after assembling in the present invention.
Figure 4:
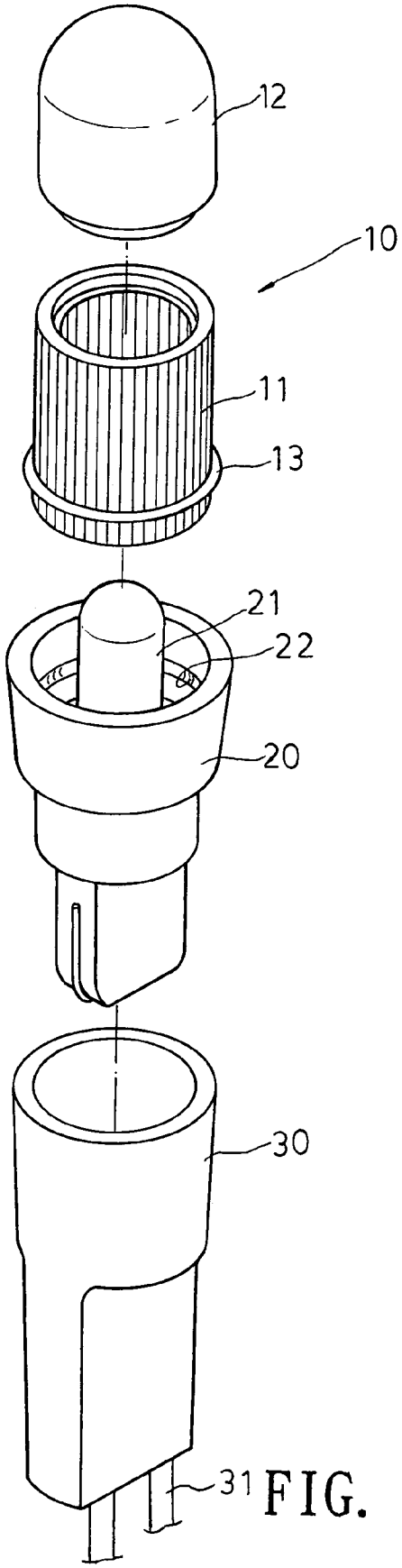
FIG. 4 is another analytic diagram of the structure in the present invention.

Please refer to those shown in FIGS. 1 to 3. The first sleeved object 11 and the second sleeved object 12 in the outer enveloping shell 10 are different colored assembling elements that can be direct shaped. They can be assemble-connected by a top-down method. Through the conjugation between the grooved rim 111 in the first sleeved object 11 and the lip rim 121 in the second object 12, these two sleeved objects can have a precise sleeve-connecting assembly. And the glue is utilized to glue-fix the integrating positions. Then, the integrated outer enveloping shell 10 is inserted in the lamp stand 20 right away and envelopes the LED lamp 21. And through the clip-connection of the protruding rim 13 and the circular groove 22 of the lamp stand 20, and the lamp stand 20 is finally insert-assembled in the stand 30 and complete the assembly of a Christmas lamp. The outer enveloping shell 10 shown in FIG. 4 is to use assembling elements shaped with different veins on the shell surfaces in the first sleeved object 11 and the second sleeved object 12, the rest configurations are the same as the aforementioned.

Figure 5:
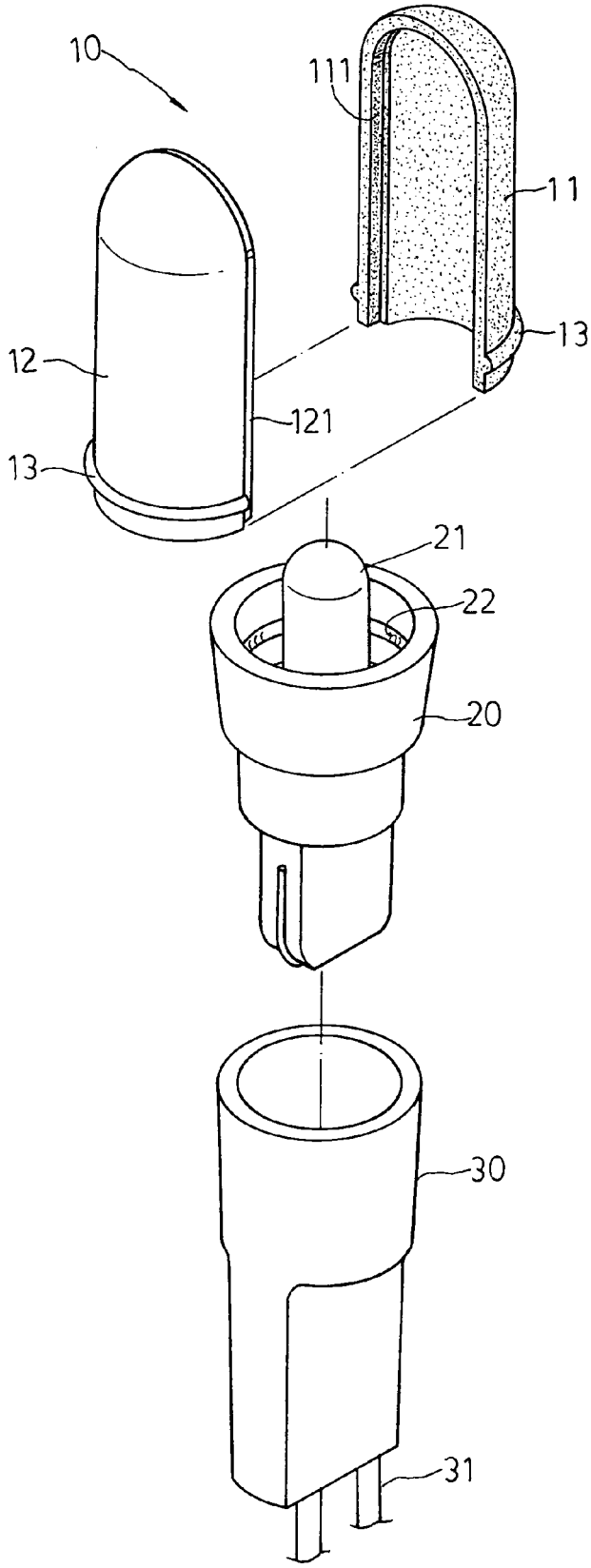
FIG. 5 to 8 are diagrams of the embodiments in the present invention.
Figure 6:
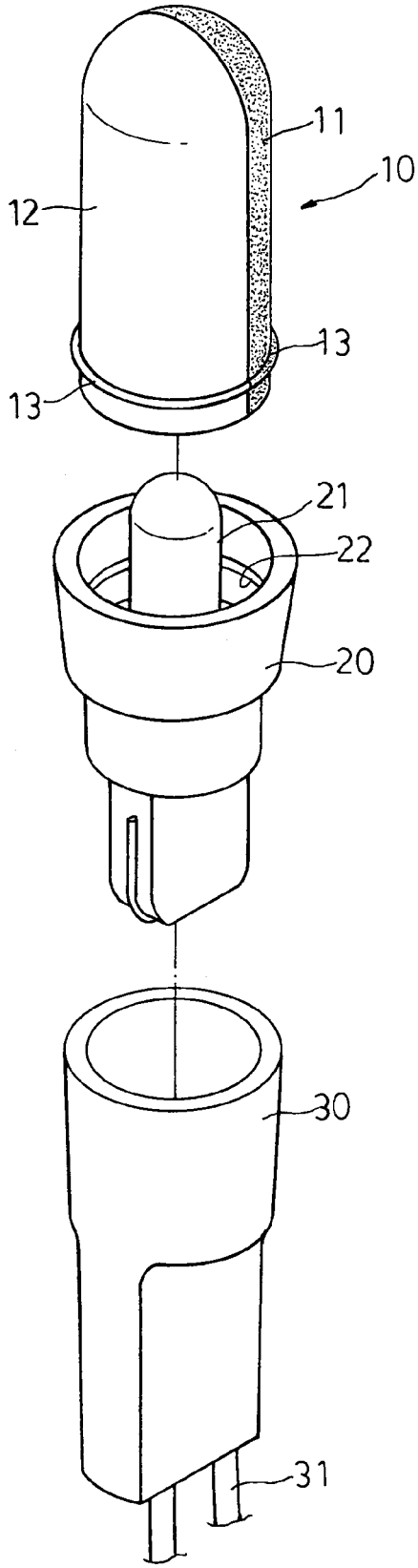
Figure 7:
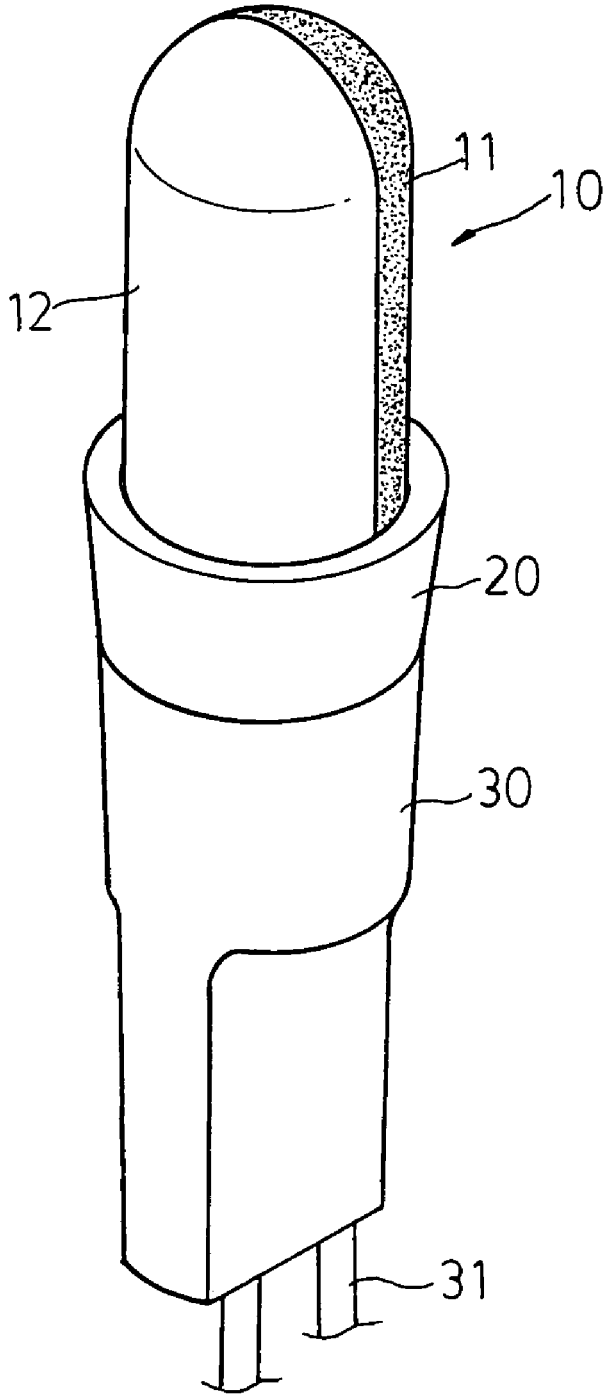
Figure 8:
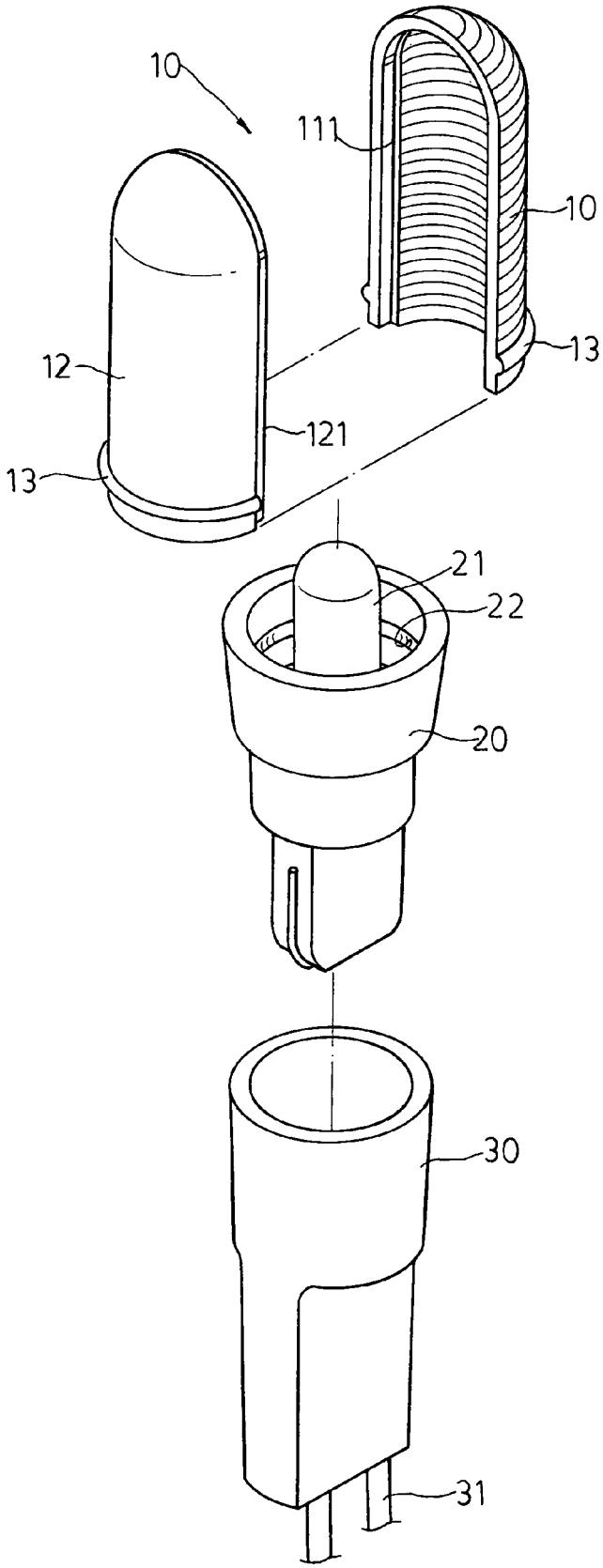

Furthermore, please refer to those shown in FIGS. 5 to 7. They are varied embodiments of the present invention. Their feature is in that the left-right method is adopted to co-assemble two different colored direct shaping elements as a whole body and form the outer enveloping shell 10. The first sleeved object 11 is a semi-circular sleeve piped configuration with a grooved rim 111 formed in rim of the opening surface and with a protruding rim 13 also formed on the outside surface close to the bottom. The second sleeved object 12 is also a semi-circular sleeve piped configuration with a lip rim 121 formed in rim of the opening surface and with a protruding rim 13 also formed on the outside surface close to the bottom. Through the conjugation between the grooved rim 111 and the lip rim 121, the first sleeved object 11 and the second sleeved object 12 can be co-assembled precisely then insert-connected in the lamp stand 20 after using the glue to fix-connect them together as a whole body. The LED lamp 21 is then enveloped. And, through the clip-connection of the protruding rim 13 and the circular groove 22, it is then insert-assembled in the stand 30. The outer enveloping shell 10 shown in FIG. 8 is to use assembling elements shaped with different veins on the shell surfaces in the left-right first sleeved object 11 and second sleeved object 12, the rest configurations are the same as the aforementioned.

I claim:

1. A structure improvement in the outer enveloping shells of Christmas lamps composed of an outer enveloping shell, a lamp stand set with a LED lamp and an integrating stand set with the power line, that is characterized in the outer shell is co-assembled by sleeved objects with different colors or different shell veins and formed as a whole; after being fix-assembled, insert-assembled in the lamp stand set and enveloping the LED lamp, then it is insert-assembled and connected with an integrating stand set.

2. A structure improvement in outer enveloping shell structure of the LED Christmas lamp as claimed in claim 1, wherein the sleeved object of the outer enveloping shell is co-assembled by a top-down method and formed as a whole.

3. A structure improvement in outer enveloping shell structure of the LED Christmas lamp as claimed in claim 1, wherein the sleeved object of the outer enveloping shell is co-assembled by a left-right method and formed as a whole.

4. A structure improvement in outer enveloping shell structure of the LED Christmas lamp as claimed in claim 1, wherein the outer enveloping shell is co-assembled by a first sleeved object and a second sleeved object and formed as a whole.

5. A structure improvement in outer enveloping shell structure of the LED Christmas lamp as claimed in claim 1, wherein a grooved rim is formed at the integrating position of the first sleeved object in the outer enveloping shell, and a lip rim is formed at the integrating position of a second sleeved object.

6. A structure improvement in outer enveloping shell structure of the LED Christmas lamp as claimed in claim 1, wherein the outer enveloping shell is co-assembled by more than two sleeved objects with different colors or different shell veins to be formed as a whole.

* * * * *